US005518639A

United States Patent [19]

Luk et al.

[11] Patent Number: 5,518,639

[45] Date of Patent: May 21, 1996

[54] POWDER METALLURGY LUBRICANT COMPOSITION AND METHODS FOR USING SAME

[75] Inventors: Sydney Luk, Lafayette Hill; Ann Lawrence, Bensalem, both of Pa.

[73] Assignee: Hoeganaes Corp., Riverton, N.J.

[21] Appl. No.: 289,783

[22] Filed: Aug. 12, 1994

[51] Int. Cl.$^6$ ..... C10M 105/00; C10M 125/00

[52] U.S. Cl. ..... 252/29; 252/25; 252/52 A; 252/52 R; 252/56 R

[58] Field of Search ..... 252/29, 52 A

[56] References Cited

U.S. PATENT DOCUMENTS

| | | | |
|---|---|---|---|
| 3,879,301 | 4/1975 | Cairns | 252/12 |
| 3,994,814 | 11/1976 | Cairns | 252/12.6 |
| 4,242,211 | 12/1980 | Nagura | 252/52 A |
| 4,715,972 | 12/1987 | Pacholke | 252/25 |
| 4,892,669 | 1/1990 | Marcora et al. | 252/30 |

*Primary Examiner*—Ellen M. McAvoy

*Attorney, Agent, or Firm*—Woodcock Washburn Kurtz Mackiewicz & Norris

[57] ABSTRACT

The present invention provides lubricant compositions for the powder metallurgical field. The lubricant compositions contain a solid phase lubricant such as graphite, molybdenum disulfide, and polytetrafluoroethylene in combination with a liquid phase lubricant that is a binder for the solid phase lubricant. The binder can be chosen from various classes of compounds including polyethylene glycols, polyethylene glycol esters, partial esters of $C_{3-6}$ polyhydric alcohols, polyvinyl esters, and polyvinyl pyrrolidones. The binder is solubilized in an organic solvent.

20 Claims, 2 Drawing Sheets

POWDER METALLURGY LUBRICANT COMPOSITION AND METHODS FOR USING SAME

FIELD OF THE INVENTION

The present invention relates to lubricant compositions for the powder metallurgy industry. Specifically, the invention relates to lubricant compositions that are applied to the surface of a die cavity prior to compaction of the metal powder composition at elevated pressures.

BACKGROUND OF THE INVENTION

The powder metallurgy industry has developed iron-based powder compositions that can be processed into integral metal parts having various shapes and sizes for uses in the automotive and electronics industries. One processing technique for producing the parts from the base powders is to charge the powder into a die cavity and compact the powder under high pressures. The resultant green part is then removed from the die cavity and sintered.

To avoid excessive wear on the die cavity, lubricants are commonly used during the compaction process. Lubrication is generally accomplished by either blending a solid lubricant powder with the iron-based powder (internal lubrication) or by spraying a liquid dispersion or solution of the lubricant onto the die cavity surface (external lubrication). In some cases, both lubrication techniques are utilized.

Lubrication by means of blending a solid lubricant into the iron-based powder composition has disadvantages. First, the lubricant generally has a density of about 1–2 g/cm$^3$, as compared to the density of the iron-based powder, which is about 7–8 g/cm$^3$. Inclusion of the less dense lubricant in the composition lowers the green density of the compacted part. Second, internal lubricants are generally not sufficiently effective for reducing the ejection pressures when manufacturing parts having part heights (the minimum distance between the opposing punches in the press) in excess of about 1–2 in. (2.5–5 cm). Finally, when the particles of internal lubricant burn off during sintering, pore spaces can be left in the compacted part, providing a source of weakness for the part.

The use of external, die wall lubricants has generally taken the form of aqueous dispersions of the solid lubricant. The use of these lubricant compositions can reduce or eliminate the need for an internal lubricant, but problems also accompany external lubrication techniques. First, the film thickness within the die cavity has a tendency to vary, and the lubricant dispersion is known to drip out of the die cavity during processing. Also, aqueous dispersions are a source of rust formation on the die cavity. Finally, various commercially available external lubricant compositions are not necessarily sufficient to adequately lower ejection forces, especially at higher compaction pressures.

According to the present invention, there is provided an external lubricant, which avoids the problems of reduced green density and sintered strength, but which provides uniform lubricity to the die wall and minimizes ejection forces.

SUMMARY OF THE INVENTION

The present invention provides lubricant compositions that are beneficially employed in the powder metallurgy industry as a compaction die wall lubricant. The lubricant composition contains a solid phase lubricant such as molybdenum disulfide, graphite, or polytetrafluoroethylene, or mixtures thereof. The lubricant composition also contains a binder for the solid lubricant. The binder aids in the distribution and uniform bonding of the solid lubricant to the die cavity surface, and also enhances the overall lubrication of the powder composition during the compaction process.

The binders useful in the lubricant compositions include:

(1) polyethylene glycols having a weight average molecular weight of from about 3000 to about 35,000;

(2) polyethylene glycol esters having a weight average molecular weight of from about 500 to about 10,000, wherein the ester functionality is formed from saturated or unsaturated $C_{12-36}$ fatty acids;

(3) partial esters of $C_{3-6}$ polyhydric alcohols wherein the ester functionality is formed from saturated or unsaturated $C_{12-36}$ fatty acids;

(4) polyvinyl esters having a weight average molecular weight of at least about 200, wherein the ester functionality is formed from saturated or unsaturated $C_{12-36}$ fatty acids;

(5) polyvinyl pyrrolidones having a weight average molecular weight of at least about 200; and (6) mixtures thereof.

The lubricant compositions, as applied to the die cavity, are in the form of a dispersion employing an organic solvent for the binder as the carrier fluid. Generally, the solid lubricant is present in an amount of from about 5 to about 50 weight percent, the binder is present in an amount of from about 1 to about 30 weight percent, and the solvent constitutes the remainder of the composition, generally from about 30 to about 90 weight percent.

DETAILED DESCRIPTION OF THE INVENTION

Figure 1:
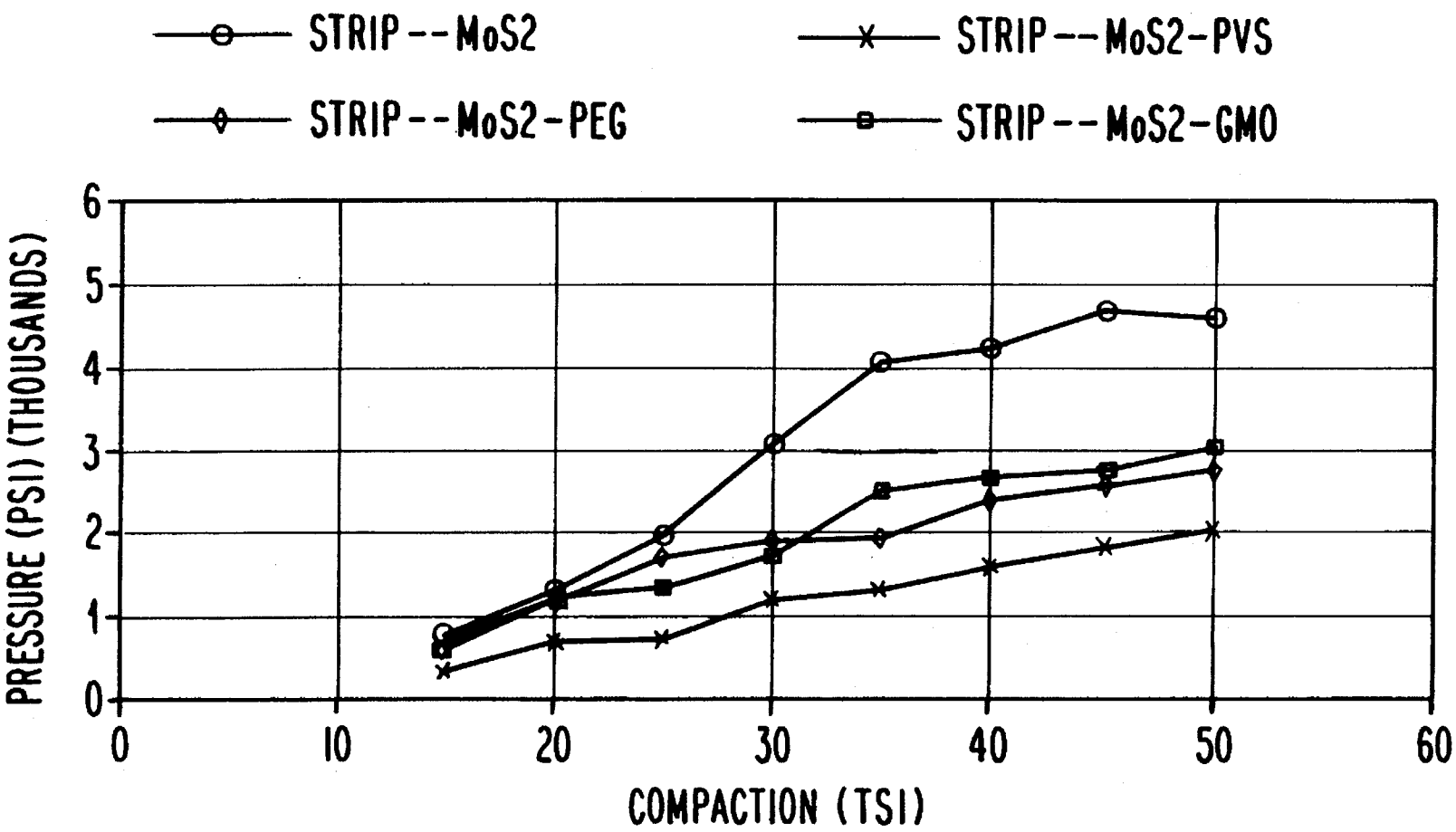
FIG. 1 is a graph of the stripping pressures in units of ksi versus compaction pressure in units of tsi for the compaction of an iron-based metal powder (Hoeganaes "85HP" powder) in 1 in. height and diameter slugs for various $MoS_2$-based lubricant compositions.

The present invention provides lubricant compositions designed for use in the powder metallurgy industry. The lubricant is generally applied to the walls of a compaction die before the powder composition is charged into the die for subsequent compaction into a metallurgical part. The lubricant composition prevents die scoring during compaction, and reduces the stripping and sliding pressures upon the ejection of the compacted part. The lubricant composition of the present invention can negate the need to supply an internal lubricant, which is blended into the powder composition prior to compaction, and thereby eliminates the problems of reduced density in the final compacted parts that can be caused by use of internal lubricants.

The lubricant compositions of the present invention contain a lubricant that is solid at temperatures at least as high as 23° C., preferably at least as high as 30° C. The binder used in the lubricant composition is a substance that anchors the solid lubricant to the die cavity wall, and also provides a lubricant second phase for the ejection of the compacted part from the die cavity. It is contemplated that the lubricant and binder will be applied to the die cavity wall in the form of a spray dispersion. The carrier liquid for the dispersion is preferably a solvent for the binder.

The lubricant compositions contain a conventional powder metallurgy solid lubricant. The solid lubricants that can be formulated into the lubricant compositions of the present invention include molybdenum disulfide ($MoS_2$), graphite, and polytetrafluoroethylene (PTFE), molybdenum disulfide being preferred; these lubricants are preferably present as a major component of the solid lubricant, at least 50% by weight, preferably at least 75% by weight, and more preferably 100% by weight of the solid lubricant. These lubricants are generally solids in their natural state at about 23° C. The weight average particle size of the solid lubricant is generally below about 20 microns, preferably below about 10 microns, more preferably below about 5 microns, and most preferably below about 3 microns. It is generally preferred that about 90 weight percent of the particles be below about 20 microns, preferably below about 15 microns, and more preferably below about 10 microns.

A binder is supplied in the lubricant composition in combination with the solid lubricant. The binder aids to distribute the lubricant and uniformly bond the lubricant to the die cavity wall surface. The binder also enhances the overall lubrication during the compaction process.

Binders that are useful in the lubricant composition include polyethylene glycols and polyethylene glycol esters. Preferred polyethylene glycols are those having weight average molecular weights ($M_w$) of from about 3000 to about 35,000. Preferred polyethylene glycol esters are those having weight average molecular weights of from about 500 to about 10,000, preferably from about 600 to about 6,000. The fatty acid moiety that forms the ester functionality is generally a saturated or unsaturated $C_{12-36}$ fatty acid, preferably a $C_{14-24}$ fatty acid, and more preferably a $C_{14-20}$ fatty acid. Fatty acids such as stearic, oleic, and lauric acids are typically useful with this class of binders. The polyethylene glycol esters can either be mono- or diesters, and the diesters can contain the same or different fatty acid moieties. The polyethylene glycol esters are preferably solids, soft solids, or waxes at about 23° C.

Other binders that are useful in the lubricant compositions are partial esters of $C_{3-6}$ polyhydric alcohols. The fatty acid moiety that forms the ester functionality is generally a saturated or unsaturated $C_{12-36}$ fatty acid, preferably a $C_{14-24}$ fatty acid, and more preferably a fatty acid. The preferred polyhydric alcohol is glycerol, and preferred glycerol partial esters are the mono- and di-glycerides, such as glycerol mono- and di-stearate, glycerol mono- and di-laureate, and glycerol mono- and di-oleate. The diesters can contain the same or different fatty acid moieties. Preferred binders from this class are solids or waxes at about 23° C., however liquid binders can also function well.

An additional class of binders that are useful in the lubricant compositions is polyvinyl esters. These binders generally have a weight average molecular weight of at least about 200, preferably at least about 300, with the weight average molecular weight generally not exceeding about 100,000. The polyvinyl esters have an ester functionality formed from saturated and unsaturated $C_{12-36}$ fatty acids, preferably $C_{14-24}$ fatty acids, and more preferably $C_{14-20}$ fatty acids. Polyvinyl stearate is particularly useful. These binders are also generally solids or waxes at about 23° C.

A further class of binders that are useful in the lubricant compositions is polyvinyl pyrrolidones. These binders generally have a weight average molecular weight of at least about 200, preferably at least about 300, with the weight average molecular weight generally not exceeding about 10,000. These binders are also generally solids or waxes at about 23° C.

The binder can also be selected from the polyvinyl esters such as polyvinyl acetates, polyvinyl alcohols, and polyvinyl acetals.

The lubricant compositions are generally supplied in a form that is readily usable in an industrial powder metallurgy compaction processing system. The binder is therefore preferably dissolved in a suitable solvent. The resulting lubricant composition can be characterized as containing the solid phase lubricant and the dissolved binder as a liquid phase lubricant. The preferred solvents are generally aliphatic and aromatic organic solvents. Examples of useful solvents, which those of skill in the art will readily recognize as compatible with the stated binders, include ketones such as acetone; $C_{1-10}$ alcohols such as ethanol, propanol, and isopropanol; $C_{5-10}$ alkanes such as hexane; aromatic alcohols; benzene; cyclohexanone; and mixtures thereof.

The lubricant compositions can be prepared with either a single lubricant or a mixture of the lubricants in combination with either a single binder or a mixture of the binders. Generally, the weight ratio of the lubricant to the binder is from about 1:1 to about 10:1, preferably from about 1:1 to about 5:1, and more preferably from about 2:1 to about 4:1.

The solid lubricant and binder are preferably presented in a final lubricant dispersion with the solvent carrier fluid. The solid lubricant is generally present in an amount of from about 10–50, preferably about 15–35, and more preferably about 20–30, weight percent, however when graphite is employed as the a solid lubricant it is generally present in an amount of from about 5–30, preferably 5–20, and more preferably 5–15, weight percent of the composition. The binder is generally present in an amount of from about 1–30, preferably about 1–20, and more preferably about 5–10, weight percent of the composition. The organic solvent constitutes the balance of the composition, and is generally present in an amount of from about 30–90, preferably about 50–90, and more preferably about 55–80, weight percent of the composition.

The lubricant compositions are preferably nonaqueous dispersions of the solid phase lubricant with the binder that is dissolved in the organic solvent. As such the water content of the lubricant compositions is generally below about 5 weight percent, preferably below about 2 weight percent, and more preferably below about 0.5 weight percent.

The compaction of powder metallurgical compositions is accomplished by well known conventional methods. Typically, the powder composition is fed via a hopper into a portion of a die cavity, the die cavity is then closed, and a pressure is applied to the die. The die is then opened and the green part is ejected from the die cavity. In accordance with the present invention, the walls of the die cavity are coated with the lubricant composition, generally in the form of a spray coating, prior to the introduction of the powder composition. The amount of the lubricant composition used is generally left to the discretion of the parts manufacturer, however an amount sufficient to uniformly wet the surface of the die cavity should be employed. It has been determined that, following a conventional spraying technique, the amount of lubricant applied to the die cavity ranges from about 1– $30\times10^{-4}$ g/cm$^2$, and generally about 5–$20\times10^{-4}$ g/cm$^2$; the amount of binder applied ranges from about 0.5–$20\times10^{-4}$ g/cm$^2$, and generally about 1–$10\times10^{-4}$ g/cm$^2$.

The powder composition is then charged into the die cavity, followed by compaction under pressure. Typical compaction pressures are at least about 25 tsi, up to about 200 tsi, and conventionally from about 40–60 tsi.

The use of the lubricant composition of the present invention reduces the stripping and sliding pressures upon ejection of the compacted green part from the die cavity. The use of the present lubricant compositions results in stripping and sliding pressures of less than about 5 ksi, preferably less than about 4 ksi, and even more preferably less than 3 ksi. With preferred embodiments of the invention, these pressures are less than 2.5 ksi, for compaction pressures of from about 40–50 tsi.

The iron-based powder compositions that are compacted with the lubricant composition of the present invention contain metal powders of the kind generally used in powder metallurgy methods. Examples of "iron-based" powders, as that term is used herein, are powders of substantially pure iron, and powders of iron pre-alloyed with other elements (for example, steel-producing elements) that enhance the strength, hardenability, electromagnetic properties, or other desirable properties of the final product.

Substantially pure iron powders that can be used in the invention are powders of iron containing not more than about 1.0% by weight, preferably no more than about 0.5% by weight, of normal impurities. Examples of such highly compressible, metallurgical-grade iron powders are the ANCORSTEEL 1000 series of pure iron powders, e.g. 1000, 1000B, and 1000C, available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85–3.00 g/cm$^3$, typically 2.94 g/cm$^3$. Other iron powders that can be used in the invention are typical sponge iron powders, such as Hoeganaes' ANCOR MH-100 powder.

The iron-based powder can incorporate one or more alloying elements that enhance the mechanical or other properties of the final metal part. Such iron-based powders can be powders of iron, preferably substantially pure iron, that has been pre-alloyed with one or more such elements. The pre-alloyed powders can be prepared by making a melt of iron and the desired alloying elements, and then atomizing the melt, whereby the atomized droplets form the powder upon solidification.

Examples of alloying elements that can be pre-alloyed with the iron powder include, but are not limited to, molybdenum, manganese, magnesium, chromium, silicon, copper, nickel, gold, vanadium, columbium (niobium), graphite, phosphorus, aluminum, and combinations thereof. The amount of the alloying element or elements incorporated depends upon the properties desired in the final metal part. Pre-alloyed iron powders that incorporate such alloying elements are available from Hoeganaes Corp. as part of its ANCORSTEEL line of powders.

A further example of iron-based powders are diffusion-bonded iron-based powders which are particles of substantially pure iron that have a layer or coating of one or more other metals, such as steel-producing elements, diffused into their outer surfaces. Such commercially available powders include DISTALOY 4600A diffusion bonded powder from Hoeganaes Corporation, which contains about 1.8% nickel, about 0.55% molybdenum, and about 1.6% copper, and DISTALOY 4800A diffusion bonded powder from Hoeganaes Corporation, which contains about 4.05% nickel, about 0.55% molybdenum, and about 1.6% copper.

A preferred iron-based powder is of iron pre-alloyed with molybdenum (Mo). The powder is produced by atomizing a melt of substantially pure iron containing from about 0.5 to about 2.5 weight percent Mo. An example of such a powder is Hoeganaes' ANCORSTEEL 85HP steel powder, which contains about 0.85 weight percent Mo, less than about 0.4 weight percent, in total, of such other materials as manganese, chromium, silicon, copper, nickel, molybdenum or aluminum, and less than about 0.02 weight percent carbon. Another example of such a powder is Hoeganaes' ANCORSTEEL 4600 V steel powder, which contains about 0.5–0.6 weight percent molybdenum, about 1.5–2.0 weight percent nickel, and about 0.1–0.25 weight percent manganese, and less than about 0.02 weight percent carbon.

Another pre-alloyed iron-based powder that can be used in the invention is disclosed in U.S. Pat. No. 5,108,493, entitled "Steel Powder Admixture Having Distinct Pre-alloyed Powder of Iron Alloys," which is herein incorporated in its entirety. This steel powder composition is an admixture of two different pre-alloyed iron-based powders, one being a pre-alloy of iron with 0.5–2.5 weight percent molybdenum, the other being a pre-alloy of iron with carbon and with at least about 25 weight percent of a transition element component, wherein this component comprises at least one element selected from the group consisting of chromium, manganese, vanadium, and columbium. The admixture is in proportions that provide at least about 0.05 weight percent of the transition element component to the steel powder composition. An example of such a powder is commercially available as Hoeganaes' ANCORSTEEL 41 AB steel powder, which contains about 0.85 weight percent molybdenum, about 1 weight percent nickel, about 0.9 weight percent manganese, about 0.75 weight percent chromium, and about 0.5 weight percent carbon.

Other iron-based powders that are useful in the practice of the invention are ferromagnetic powders. An example is a powder of iron pre-alloyed with small amounts of phosphorus.

The particles of iron or pre-alloyed iron can have a weight average particle size as small as one micron or below, or up to about 850–1,000 microns, but generally the particles will have a weight average particle size in the range of about 10–500 microns. Preferred are iron or pre-alloyed iron particles having a maximum number average particle size up to about 350 microns.

EXAMPLE

A metal powder composition was compacted into 1 in. (2.5 cm) height and diameter slugs at room temperature using several molybdenum disulfide ($MoS_2$) based lubricant compositions. The die cavity surface was initially sprayed with the lubricant composition, and the solvent was allowed to evaporate before the die was charged with the powder composition. The spray was created by using a stainless steel atomizer fitted with a fine spray nozzle. The powder composition was the commercially available Hoeganaes 85HP powder. About 90 g of the 85HP powder was charged into a Tinius Olsen press. The die cavity was then closed and a compaction pressure applied to the die. Stripping and sliding pressures were recorded during ejection of the compacted slug. The strip and slide pressures were measured as follows. After the compaction step, one of the punches was removed from the die, and pressure was placed on the second punch in order to push the part from the die. The load necessary to initiate movement of the part was recorded. Once the part began to move, the part was pushed from the die at a rate of 0.10 cm (0.04 in.) per second. The load applied at the point where the part reached the mouth of the die was also recorded. The measurement was preferably performed at the same press speed and time so that the part was always in the same area of the die cavity. These loads were then converted into a pressure by dividing by the area of the part in contact with the die body. The stripping pressure was the pressure for the process at the point where movement was initiated. The sliding pressure was the pressure observed as the part traverses the distance from the point of compaction to the mouth of the die. The die cavity was thoroughly cleaned after each slug was removed.

Three $MoS_2$ lubricant compositions were prepared using the following binders: polyvinyl stearate (PVS) ($M_w$= 65,000; $M_n$=20,000), polyethylene glycol (PEG) ($M_w$= 3350), and glycerol monostearate (GMO). The $MoS_2$ lubricant compositions contained 25% wt. $MoS_2$ and 7.5% wt. of the binder. The solvent for the PVS composition was hexane, for the PEG composition was denatured ethanol, and for the GMO composition was isopropanol, with the solvent constituting the remainder of the lubricant composition. As a control lubricant composition, a 25% wt. solution of $MOS_2$ in denatured ethanol was prepared.

Figure 2:
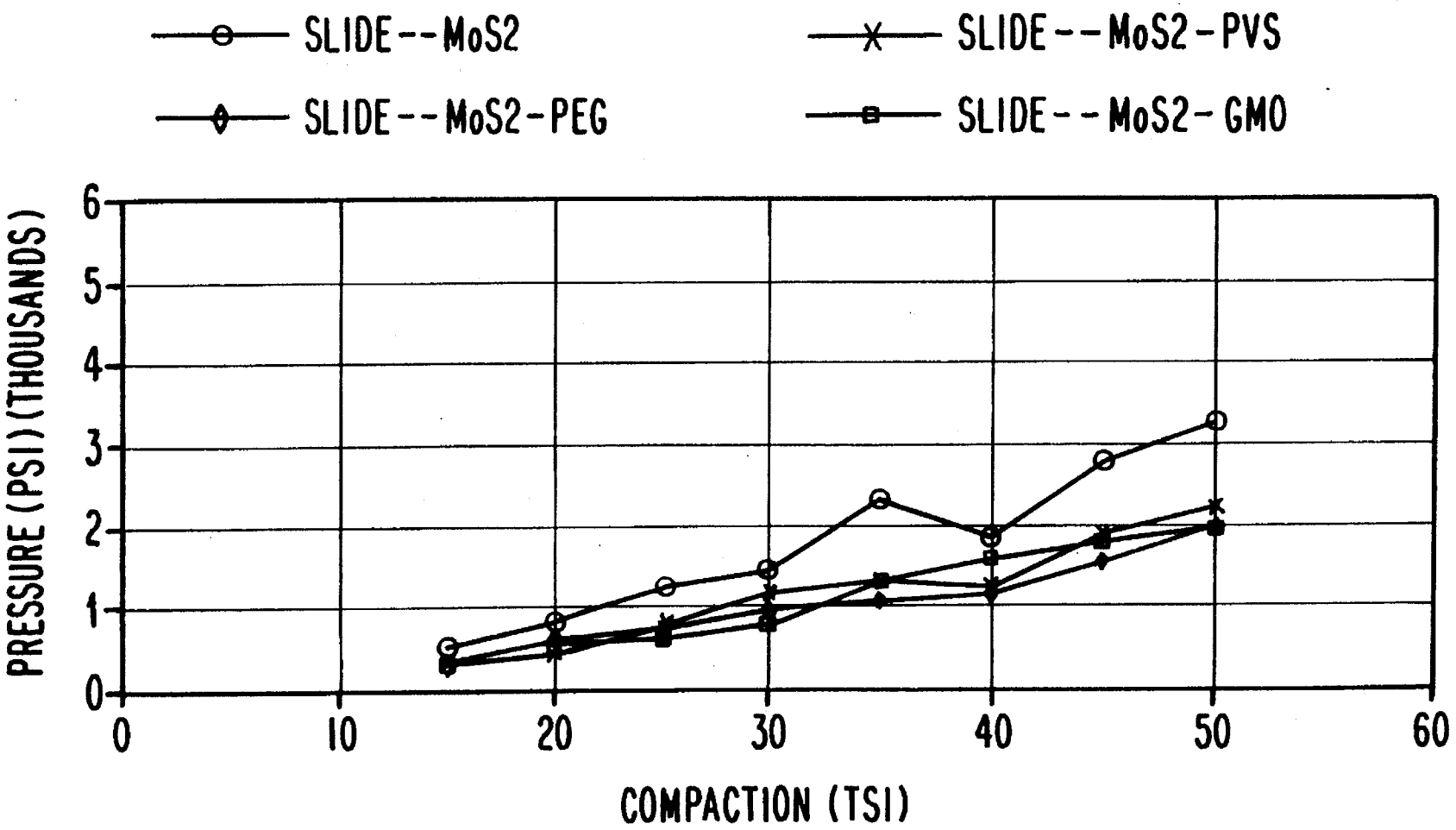
FIG. 2 is a graph of the sliding pressures in units of ksi versus compaction pressure in units of tsi for the compaction of an iron-based metal powder (Hoeganaes "85HP" powder) in 1 in. height and diameter slugs for various $MoS_2$-based lubricant compositions.

The compaction of the 85HP powder using the four different lubricant compositions was conducted at pressures ranging from 15 to 50 tsi, and in 5 tsi increments. The results for the stripping and sliding pressures upon ejection from the die cavity are shown graphically in FIGS. 1 and 2, respectively, and in numerical form in Table 1. The stripping and sliding pressures were both significantly reduced, especially at the higher compaction pressures, with the most noticeable effects shown with respect to the stripping pressures. These lower pressures indicate that less die wear would occur during a high volume commercial production run. The experimentation using the $MoS_2$-PVS lubricant composition provided a second global maximum for the stripping pressure after the initial strip of the part from the die cavity at pressures of 25 tsi and higher. This pressure was used as the recorded value and was about 10–12% higher than the initial stripping pressure.

TABLE 1

$MoS_2$ - BASED DIE WALL LUBRICANTS

| | $MoS_2$ | | $MoS_2$-PVS | | $MoS_2$-PEG | | $MoS_2$-GMO | |
|---|---|---|---|---|---|---|---|---|
| Compaction (tsi) | Strip (psi) | Slide (psi) | Strip (psi) | Slide (psi) | Strip (psi) | Slide (psi) | Strip (psi) | Slide (psi) |
| 15 | 794 | 525 | 371 | 318 | 770 | 283 | 627 | 297 |
| 20 | 1286 | 785 | 724 | 619 | 1113 | 441 | 1203 | 490 |
| 25 | 1949 | 1236 | 728 | 764 | 1695 | 709 | 1343 | 609 |
| 30 | 3082 | 1459 | 1211 | 1165 | 1889 | 925 | 1725 | 745 |
| 35 | 4101 | 2304 | 1316 | 1308 | 1898 | 1078 | 2519 | 1287 |
| 40 | 4226 | 1813 | 1586 | 1618 | 2394 | 1141 | 2643 | 1198 |
| 45 | 4699 | 2774 | 1811 | 1819 | 2525 | 1527 | 2707 | 1891 |
| 50 | 4577 | 3240 | 2043 | 1969 | 2750 | 1998 | 2968 | 2191 |

What is claimed is:

1. A powder metallurgy lubricant composition, comprising:

(a) from about 5 to about 50 weight percent of a solid lubricant that comprises, as a major component, graphite, molybdenum disulfide, or polytetrafluoroethylene, or mixtures thereof;

(b) from about 1 to about 30 weight percent of a binder for said lubricant, said lubricant binder comprising (1) polyethylene glycols having a weight average molecular weight of from about 3000 to about 35,000;

(2) polyethylene glycol esters having a weight average molecular weight of from about 500 to about 10,000, wherein the ester functionality is formed from saturated or unsaturated $C_{12-36}$ fatty acids;

(3) partial esters of $C_{3-6}$ polyhydric alcohols wherein the ester functionality is formed from saturated or unsaturated $C_{12-36}$ fatty acids;

(4) polyvinyl esters having a weight average molecular weight of at least about 200, wherein the ester functionality is formed from saturated or unsaturated $C_{12-36}$ fatty acids;

(5) polyvinyl pyrrolidones having a weight average molecular weight of at least about 200; or (6) mixtures thereof; and (c) from about 30 to about 90 weight percent an organic solvent for the lubricant binding agent.

wherein the weight ratio of the lubricant to the binder is from about 1:1 to about 10:1.

2. The composition of claim 1 wherein said lubricant comprises molybdenum disulfide.

3. The composition of claim 2 wherein said lubricant binder comprises said polyethylene glycols.

4. The composition of claim 2 wherein said lubricant binder comprises said polyethylene glycol esters wherein the ester functionality is formed from $C_{14-24}$ fatty acids.

5. The composition of claim 2 wherein said lubricant binder comprises glycerol partial esters wherein the ester functionality is formed from $C_{14-24}$ fatty acids.

6. The composition of claim 2 wherein said lubricant binder comprises said polyvinyl esters wherein the ester functionality is formed from $C_{14-24}$ fatty acids.

7. The composition of claim 2 wherein said lubricant binder comprises said polyvinyl pyrrolidones,

8. A powder metallurgy lubricant composition, comprising:

(a) from about 5 to about 50 weight percent of a lubricant that comprises, as major component, graphite, molybdenum disulfide, polytetrafluoroethylene, or mixtures thereof;

(b) from about 1 to about 20 weight percent of a binder for said lubricant, said lubricant binder comprising (1) polyethylene glycols having a weight average molecular weight of from about 3000 to about 35,000;

(2) polyethylene glycol esters having a weight average molecular weight of from about 500 to about 10,000, wherein the ester functionality is formed from saturated or unsaturated $C_{14-24}$ fatty acids;

(3) partial esters of $C_{3-6}$ polyhydric alcohols wherein the ester functionality is formed from saturated or unsaturated $C_{14-24}$ fatty acids;

(4) polyvinyl esters having a weight average molecular weight of at least about 200, wherein the ester functionality is formed from saturated or unsaturated $C_{14-24}$ fatty acids;

(5) polyvinyl pyrrolidones having a weight average molecular weight of at least about 200; or (6) mixtures thereof; and (c) from about 50 to about 90 weight percent an organic solvent for the lubricant binding agent.

9. The composition of claim 8 wherein said lubricant comprises at least about 75% by weight molybdenum disulfide.

10. The composition of claim 9 wherein said lubricant binder comprises said polyethylene glycols.

11. The composition of claim 9 wherein said lubricant binder comprises said polyethylene glycol esters wherein the ester functionality is formed from $C_{14-20}$ fatty acids.

12. The composition of claim 9 wherein said lubricant binder comprises glycerol partial esters wherein the ester functionality is formed from $C_{14-20}$ fatty acids.

13. The composition of claim 9 wherein said lubricant binder comprises glycerol monooleate.

14. The composition of claim 9 wherein said lubricant binder comprises said polyvinyl esters wherein the ester functionality is formed from $C_{14-20}$ fatty acids.

15. The composition of claim 9 wherein said lubricant binder comprises polyvinyl stearate having a weight average molecular weight of at least about 200.

16. The composition of claim 9 wherein said lubricant binder comprises said polyvinyl pyrrolidones.

17. A lubricant composition adapted to be dispersed in an organic solvent, comprising:

(a) a solid lubricant that comprises, as a major component, graphite, molybdenum disulfide, polytetrafluoroethylene, or mixtures thereof; and (b) a binder for said lubricant, said lubricant binder comprising (1) polyethylene glycols having a weight average molecular weight of from about 3000 to about 35,000;

(2) polyethylene glycol esters having a weight average molecular weight of from about 500 to about 10,000, wherein the ester functionality is formed from saturated and unsaturated $C_{12-36}$ fatty acids;

(3) partial esters of $C_{3-6}$ polyhydric alcohols wherein the ester functionality is formed from saturated and unsaturated $C_{12-36}$ fatty acids;

(4) polyvinyl esters having a weight average molecular weight of at least about 200, wherein the ester functionality is formed from saturated and unsaturated $C_{12-36}$ fatty acids;

(5) polyvinyl pyrrolidones having a weight average molecular weight of at least about 200; or (6) mixtures thereof;

wherein the weight ratio of the lubricant to the binder is from about 1:1 to about 10:1.

18. The composition of claim 7 wherein said binder comprises from about 1 to about 20 weight percent of said composition and wherein the weight ratio of the lubricant to the binder is from about 1:1 to about 5:1.

19. The composition of claim 9 wherein the weight ratio of the lubricant to the binder is from about 1:1 to about 5:1.

20. The composition of claim 17 wherein the weight ratio of the lubricant to the binder is from about 1:1 to about 5:1.

* * * * *